United States Patent [19]

Wolff

[11] Patent Number: 4,845,022

[45] Date of Patent: Jul. 4, 1989

[54] COLOR PHOTOGRAPHIC RECORDING MATERIAL CONTAINING A COLOR COUPLER OF THE PYRAZOLOAZOLE TYPE

[75] Inventor: Erich Wolff, Solingen, Fed. Rep. of Germany

[73] Assignee: Agfa-Gevaert Aktiengessellschaft, Leverkuse, Fed. Rep. of Germany

[21] Appl. No.: 69,886

[22] Filed: Jul. 6, 1987

[30] Foreign Application Priority Data

Jul. 19, 1986 [DE] Fed. Rep. of Germany ..... 3625544

[51] Int. Cl.[4] ..... G03C 7/38

[52] U.S. Cl. ..... 430/558; 430/386

[58] Field of Search ..... 430/558, 386, 387

[56] References Cited

U.S. PATENT DOCUMENTS

| | | | |
|---|---|---|---|
| 4,511,649 | 4/1985 | Ogawa et al. | 430/558 |
| 4,525,450 | 6/1985 | Itoh et al. | 430/558 |
| 4,659,652 | 4/1987 | Kawagishi et al. | 430/558 |
| 4,675,275 | 6/1987 | Nishijima et al. | 430/558 |
| 4,704,350 | 11/1987 | Morigaki et al. | 430/558 |

*Primary Examiner*—Paul R. Michl

*Assistant Examiner*—Mark R. Buscher

*Attorney, Agent, or Firm*—Connolly & Hutz

[57] ABSTRACT

Photographic color images with improved sensitometric properties and in particular with high maximum magenta density can be obtained by use of a color photographic recording material containing a pyrazoloazole type magenta coupler of formula I

I in which

PAZ represents the group of a color coupler of the pyrazoloazole series capable of color coupling;

L represents a bond containing at least 4 carbon atoms;

B represents alkyl, aryl or a heterocyclic group;

$R^1$ represents H, halogen, alkyl, alkoxy;

$R^2$ represents H, alkyl, cycloalkyl;

L and B together containing at least 12 carbon atoms.

3 Claims, No Drawings

COLOR PHOTOGRAPHIC RECORDING MATERIAL CONTAINING A COLOR COUPLER OF THE PYRAZOLOAZOLE TYPE

This invention relates to a color photographic recording material containing at least one silver halide emulsion layer and a color coupler of the pyrazoloazole type which enables magenta dye images of high color density to be produced by virtue of the presence of a special group in the ballast group.

It is known that colored photographic images can be produced by chromogenic development, i.e. by developing silver halide emulsion layers which have been exposed imagewise in the presence of suitable color couplers using suitable dye-producing developer compounds (so-called color developers), the oxidation product of the developer compounds formed in correspondence with the silver image reacting with the color coupler to form a dye image. The color couplers used are normally aromatic compounds containing primary amino groups, particularly those of the p-phenylenediamine type.

Pyrazolone couplers are normally used for producing magenta dye images. The image dyes obtained from these pyrazolone couplers often show far from ideal absorption. Particularly troublesome is the yellow secondary color density which necessitates the use of masking couplers or the application of other masking techniques in order to obtain brilliant colors in the photographic image. Further disadvantages of standard pyrazolone couplers are their frequently inadequate stability to the effect of formaldehyde and to the effect of light, heat and moisture during storage.

Magenta couplers of the pyrazoloazole type have proved to be of advantage in this respect. They generally give magenta color images of greater color purity. However, it is difficult in their case to obtain adequate color density during normal processing. Magenta couplers of the pyrazoloazole type are described, for example, in DE-A 1 810 462, in DE-A 35 16 996, in EP-A-0 143 570 and in EP-A-0 176 804.

The object of the present invention is to provide a color photographic recording material containing at least one silver halide emulsion layer and at least one magenta coupler from which magenta dyes having the desired color purity and high color density can be produced by chromogenic development.

The present invention relates to a color photographic recording material containing at least one silver halide emulsion layer and at least one color coupler of the pyrazoloazole type which contains a diffusion-inhibiting radical having the following structure

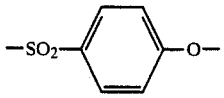

characterized in that the coupler corresponds to the following general formula

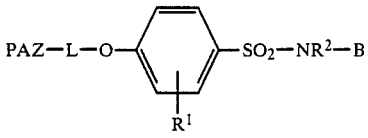

I in which

PAZ is the group of a color coupler of the pyrazoloazole series capable of color coupling;

L is a bond containing at least 4 carbon atoms;

B is alkyl, aryl or a heterocyclic group;

$R^1$ is H, halogen, alkyl, alkoxy;

$R^2$ is H, alkyl, cycloalkyl;

L and B together containing at least 12 carbon atoms.

The coupling group PAZ may stand for a residue of imidazolo[1,2-b]pyrazole, imidazolo[3,4-b]pyrazole, pyrazolo[2,3-b]pyrazole, pyrazolo[3,2-c]-1,2,4-triazole, pyrazolo[2,3-b]-1,2,4-triazole, pyrazolo[2,3-c]-1,2,3-triazole or pyrazolo[2,3-d]tetrazole. The corresponding structures are represented in the following by formulae I-1 to I-7:

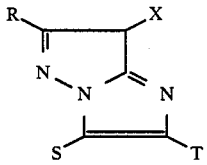

I-1

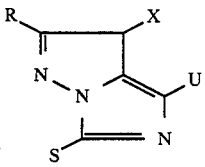

I-2

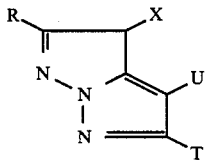

I-3

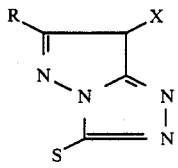

I-4

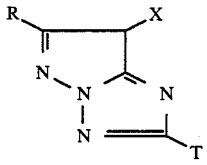

I-5

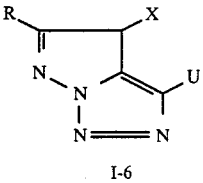

I-6

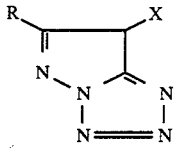

I-7

In general formulae I-1 to I-7, the substitutents R, S, T and U represent hydrogen, alkyl, aralkyl, aryl, alkoxy, aroxy, alkylthio, arylthio, amino, anilino, acyamino, cyano, alkoxycarbonyl, carbamoyl, sulfamoyl; these substituents may be further substituted. In each of formulae I-1 to I-7, however, at least one of the substituents R, S, T and U represents the following group

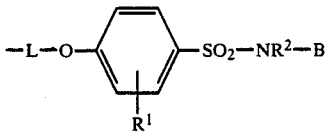

as defined in formula I. In addition, X is hydrogen or a group releasable during the color coupling reaction, such as a halogen atom or a preferably cyclic group attached to the coupling position by an oxygen atom, a sulfur atom or a nitrogen atom.

If the releasable group is a cyclic group, it may be attached to the coupling position of the coupler molecule either directly through an atom which is part of a ring, for example a nitrogen atom, or indirectly through an intermediate bond. Releasable groups such as these are known in large numbers, for example as leaving groups of 2-equivalent magenta couplers.

Examples of releasable groups attached by oxygen correspond to the following formula $$-O-R^3,$$

in which $R^3$ is an acyclic or cyclic organic radical, for example alkyl, aryl, a heterocyclic group or acyl derived, for example, from an organic carboxylic or sulfonic acid. In particularly preferred releasable groups of this type, $R^3$ is an optionally substituted phenyl group.

Examples of releasable groups attached by nitrogen can be found in the following German Offenlegungsschrifts (DE-A-): 25 36 191, 27 03 589, 28 13 522, 33 39 201.

The groups in question are frequently 5-membered heterocyclic rings which are attached to the coupling position of the magenta coupler by a ring nitrogen atom. The heterocyclic rings frequently contain activating groups, for example carbonyl or sulfonyl groups, or double bonds adjacent the nitrogen atom responsible for attachment to the coupler molecule.

Where the releasable group is attached to the coupling position of the coupler by a sulfur atom, the group in question may be the residue of a diffusible carbocyclic or heterocyclic mercapto compound which is capable of inhibiting the development of silver halide. Inhibiting residues of this type have frequently been described as releasable groups attached to the coupling position of couplers, including magenta couplers, for example in U.S. Pat. No. 3,227,554.

The bond—L—attached to a non-coupling position may have a composite structure and may be represented, for example, as follows:

$$-(L^1)_l-(L^2)_m-L^4-$$

in which $L^4$ represents that part of the bond situated next to the sulfamoylphenoxy group, l, m, n=0 or 1, $L^1$ is —O—, —NH—, —NH—CO—;

$L^2$ is alkylene, aralkylene or arylene;

$L^3$ is —NH—CO—, —CO—, —NH—, —O—;

$L^4$ is alkylene containing from 1 to 19 carbon atoms, aralkylene or arylene or (where l, m, n=0) represents a bond having the following structure

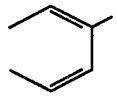

with the proviso that n=1 where m=1.

The alkylene radical represented by $L_4$ is preferably an alkylidene radical.

The alkyl and aryl radicals represented by B in formula I are preferably substituted by a nonionic hydrophilic group, for example by a hydroxyl group, and may optionally contain further substituents, more especially alkyl sulfonyl or aryl sulfonyl groups. The following are examples of such radicals:

$$-CH_2-CH_2-OH,\ -CH_2-CH_2-CH_2-OH,$$

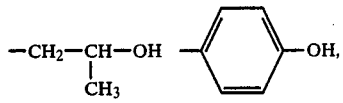

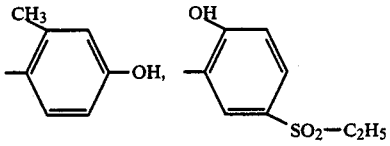

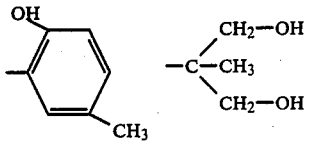

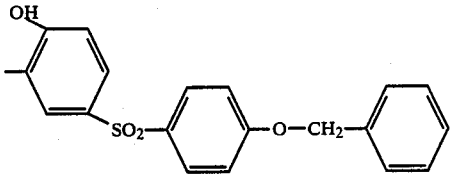

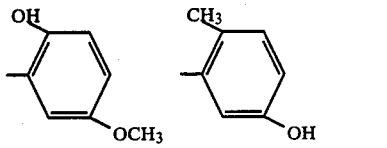

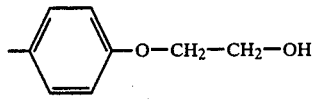

Examples of pyrazoloazole couplers according to the invention are given in the following:

| Coupler (M-) | Formula (I-) | R | X | S | T |
|---|---|---|---|---|---|
| 1 | 1 | $-CH_3$ | Cl | $HO-CH_2-CH_2-NH-SO_2-C_6H_4-O-CH(C_{12}H_{25})-CO-NH-C_6H_4-(CH_2)_3-$ | $-CH_3$ |
| 2 | 1 | $-CH_3$ | H | $HO-CH_2-CH_2-NH-SO_2-C_6H_4-O-CH(C_4H_9)-CO-NH-C_6H_4-(CH_2)_3-$ | $-CH_3$ |
| 3 | 1 | $-C_4H_9-t$ | 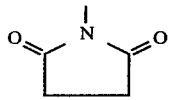 | " | $-CH_3$ |
| 4 | 1 | $-CH_3$ | 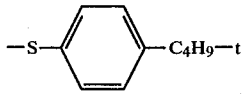 | " | $-CH_3$ |
| 5 | 1 | $-CH_3$ | 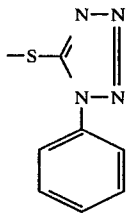 | " | $-CH_3$ |
| Coupler (M-1) | Formula (I-) | R | X | S | T |
|---|---|---|---|---|---|
| 6 | 1 | $-CH_3$ | Cl | $-C_2H_5$ | $HO-C_6H_4-NH-SO_2-C_6H_4-O-CH(C_{10}H_{21})-CO-NH-C_6H_4-(CH_2)_3-$ |
| 7 | 1 | $-CH_3$ | 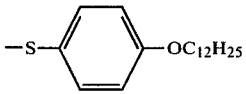 | $-C_2H_5$ | $HO-C_6H_3(CH_3)-NH-SO_2-C_6H_4-O-CH(C_{12}H_{25})-CO-NH-C_6H_4-(CH_2)_3-$ |

-continued
| | | | | | |
|---|---|---|---|---|---|
| 8 | 1 | $-CH_3$ | Cl | $-C_2H_5$ | 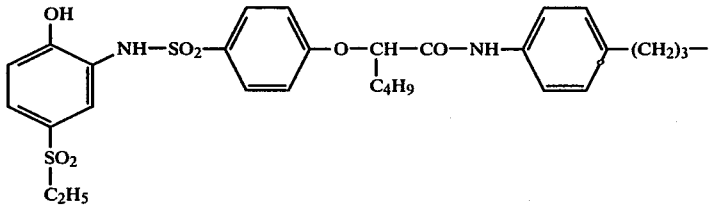 |
| 9 | 1 | $-C_2H_5$ | 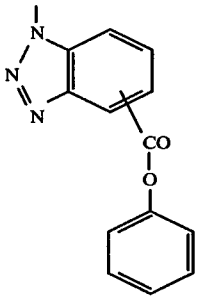 | $-C_2H_5$ | 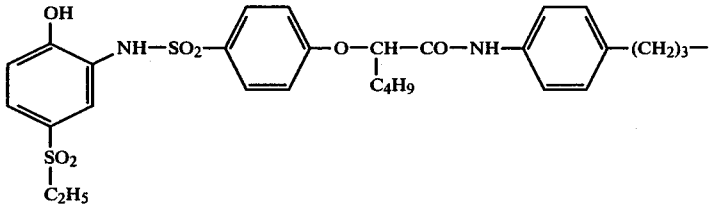 |
| M-10 | | | | | 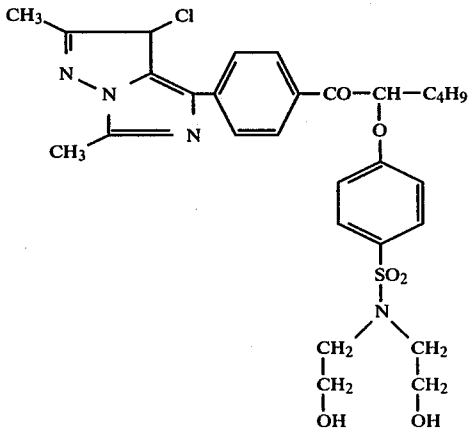 |
| Coupler (M-) | Formula (I-) | R | X | S | U |

-continued
| | | | | | |
|---|---|---|---|---|---|
| 11 | 2 | $-CH_3$ | Cl | 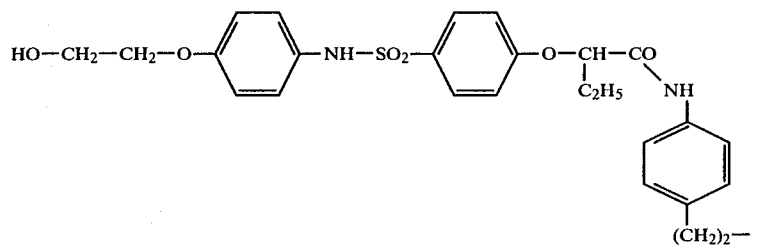 | $-CH_3$ |
| 12 | 2 | $-CH_3$ | 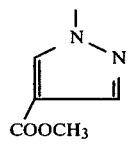 | 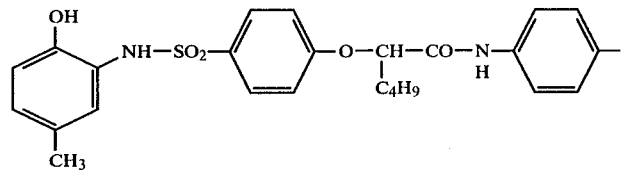 | $-CH_3$ |
| 13 | 2 | $-C_2H_5$ | Cl | 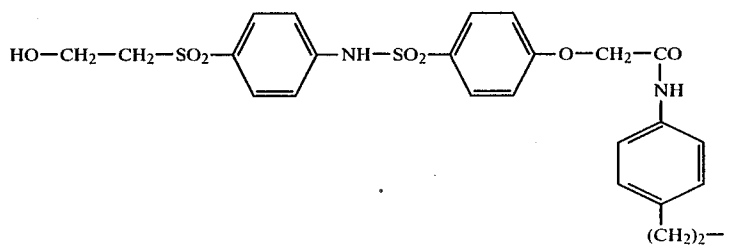 | $-CH_3$ |

-continued
M-14
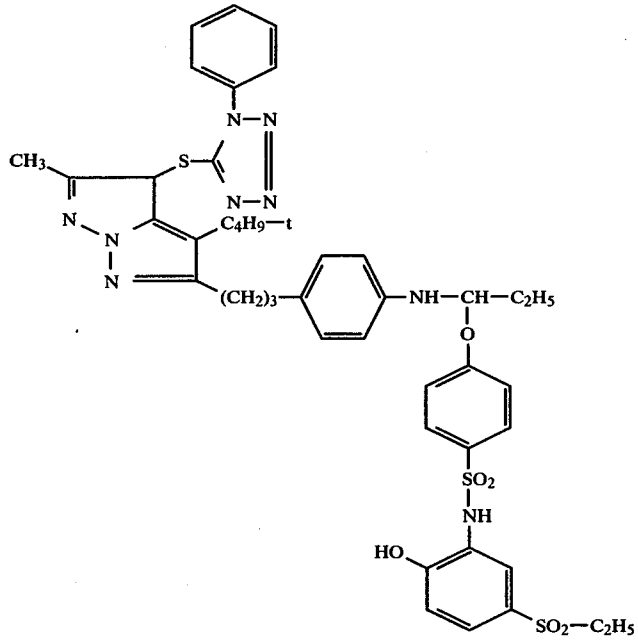
| Coupler (M-) | Formula (I-) | R | X | S |
|---|---|---|---|---|
| 15 | 4 | $-CH_3$ | Cl | 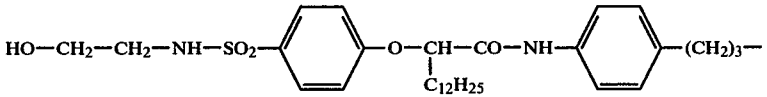 |
| 16 | 4 | $-CH_3$ | Cl | 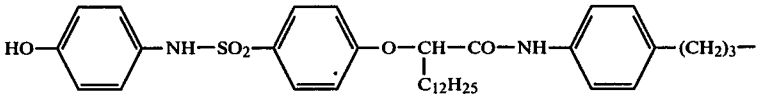 |
| 17 | 4 | $-CH_3$ | Cl | 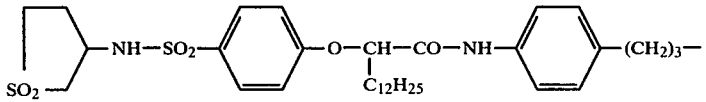 |

-continued
| | | | | |
|---|---|---|---|---|
| 18 | 4 | $-CH_3$ | Cl | 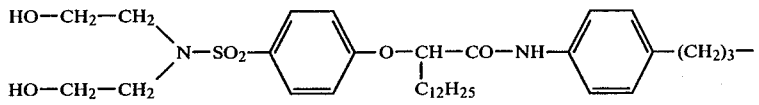 |
| 19 | 4 | $-CH_3$ | Cl | 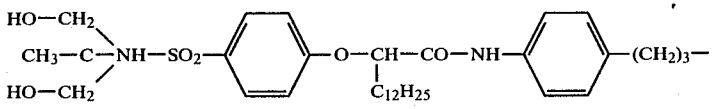 |
| 20 | 4 | $-CH_3$ | Cl | 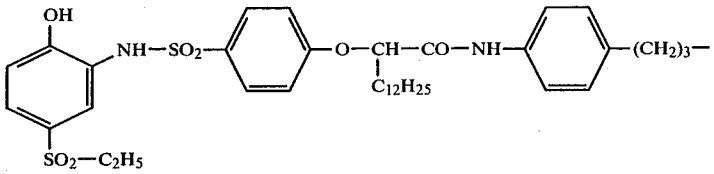 |
| 21 | 4 | $-CH_3$ | Cl | 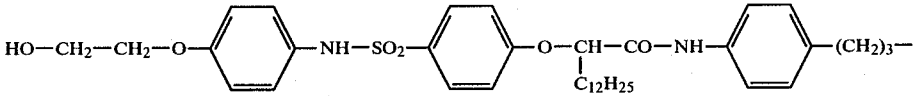 |
| 22 | 4 | $-CH_3$ | Cl | 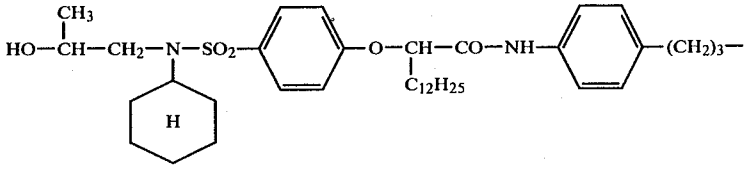 |
| 23 | 4 | $-CH_3$ | Cl | 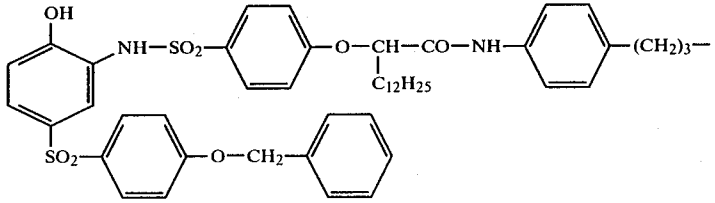 |

-continued
| | | | | |
|---|---|---|---|---|
| 24 | 4 | $-CH_3$ | Cl | 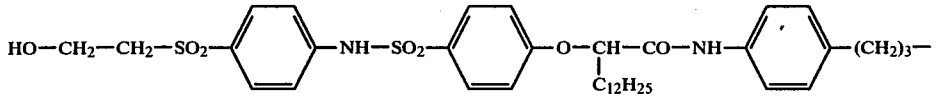 |
| 25 | 4 | $-CH_3$ | Cl | 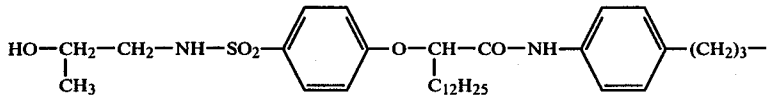 |
| 26 | 4 | $-CH_3$ | Cl | 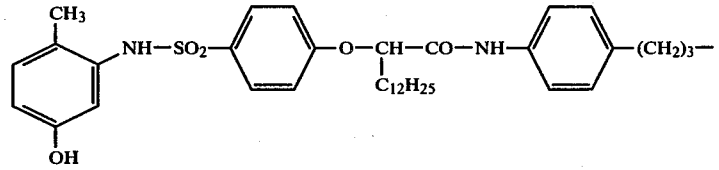 |
| 27 | 4 | $-CH_3$ | Cl | 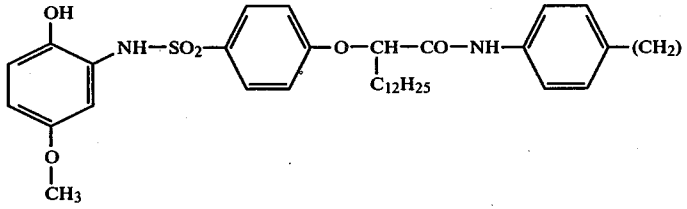 |
| Coupler (M-) | Formula (I-) | R | X | T |
|---|---|---|---|---|
| 28 | 5 | $-CH_3$ | Cl | 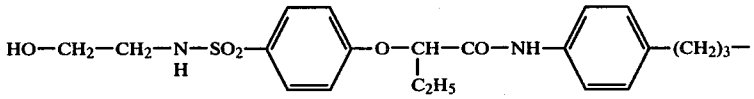 |
| 29 | 5 | $-C_4H_9-t$ | 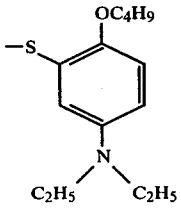 | 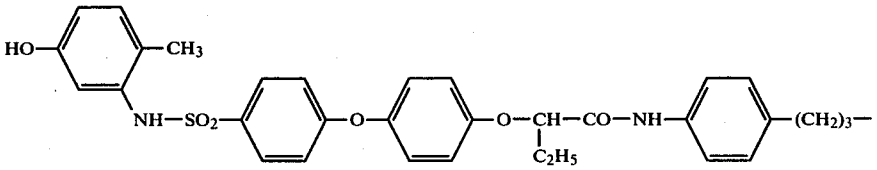 |

-continued
| | | | | |
|---|---|---|---|---|
| 30 | 5 | $-C_2H_5$ | 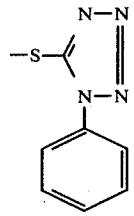 | 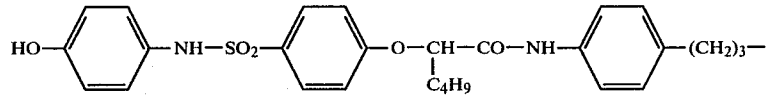 |
| 31 | 5 | $-CH_3$ | H | 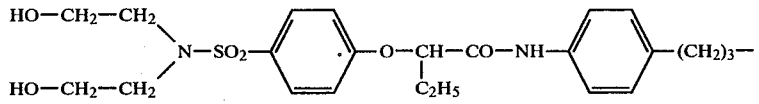 |
| 32 | 5 | $-CH_3$ | Cl | 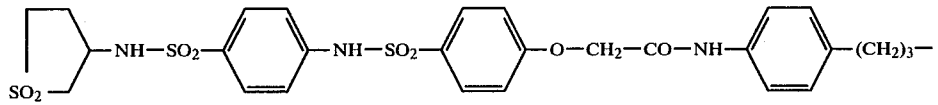 |
| 33 | 5 | $-CH_3$ | Cl | 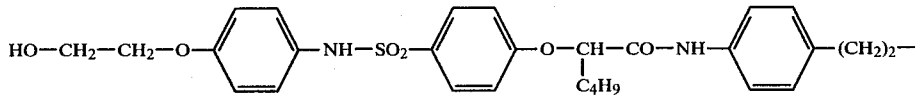 |
| Coupler (M-) | Formula (I-) | R | X | U |
|---|---|---|---|---|
| 34 | 6 | $-CH_3$ | Cl | 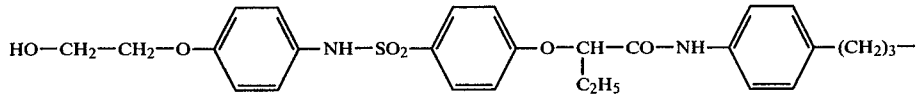 |
| 35 | 6 | $-CH_3$ | H | 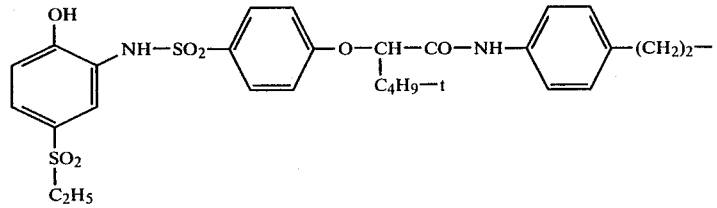 |

-continued
| | | | | |
|---|---|---|---|---|
| 36 | 6 | $-C_4H_9-t$ | 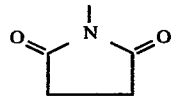 | " |
| 37 | 6 | $-CH_3$ | 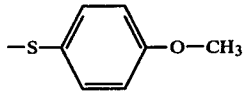 | " |
| 38 | 6 | $-CH_3$ | 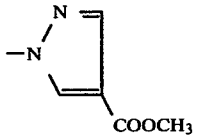 | 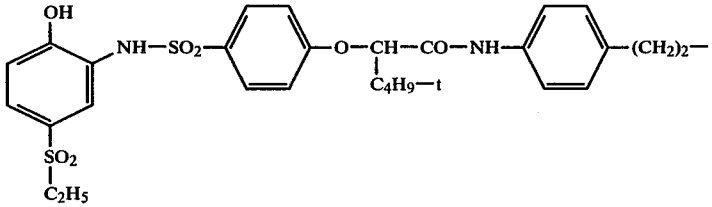 |
| 39 | 6 | $-CH_3$ | 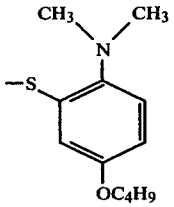 | " |
| Coupler (M-) | Formula (I-) | R | X | S/T |
|---|---|---|---|---|
| 40 | 1 | $-CH_3$ | Cl | 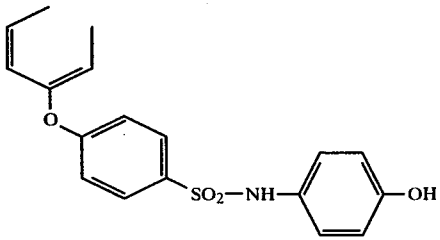 |

-continued
| | | | | |
|---|---|---|---|---|
| 41 | 1 | $-CH_3$ | Cl | 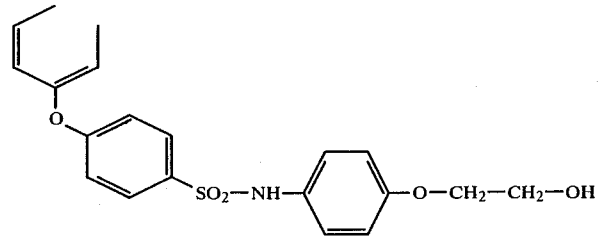 |
| 42 | 1 | $-C_4H_9-t$ | 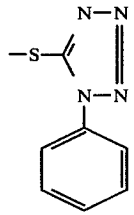 | 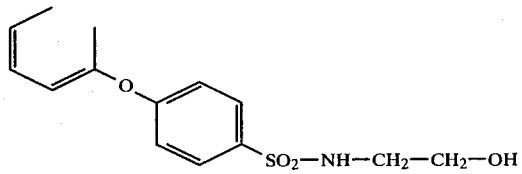 |
| 43 | 1 | $-CH_3$ | 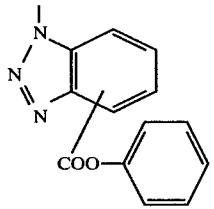 | " |
| 44 | 1 | $-OCH_3$ | Cl | " |
| 45 | 1 | $-C_{12}H_{25}$ | H | " |
| 46 | 1 | $-CH_3$ | 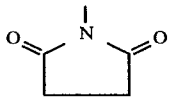 | 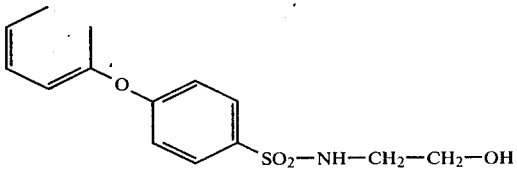 |
| 47 | 1 | $-NH-CO-C_4H_9-t$ | Cl | " |

-continued
| | | | | |
|---|---|---|---|---|
| 48 | 1 | $-CH_3$ | 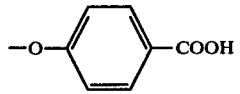 | 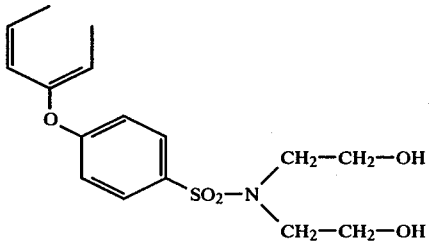 |
| 49 | 1 | $-CH_3$ | 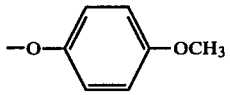 | " |
| 50 | 1 | $-CH_3$ | Cl | 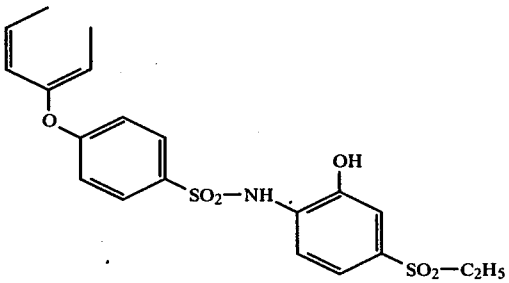 |
| Coupler (M-) | Formula (I-) | R | X |
|---|---|---|---|
| 51 | 7 | 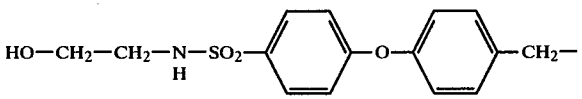 | Cl |

-continued
| | | | |
|---|---|---|---|
| 52 | 7 | 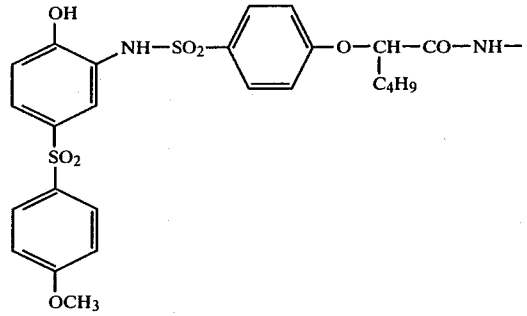 | Cl |
| 53 | 7 | " | 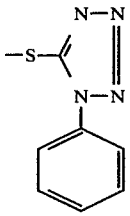 |
| 54 | 7 | 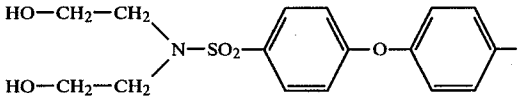 | Cl |
| 55 | 7 | 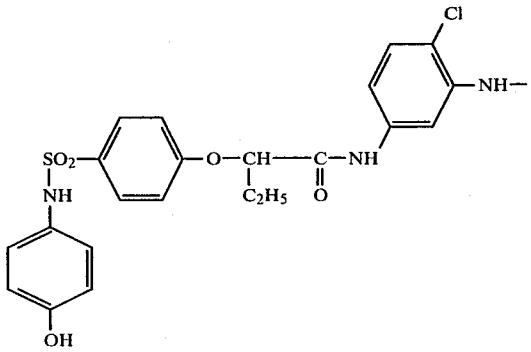 | H |

-continued
| | | | |
|---|---|---|---|
| 56 | 7 | 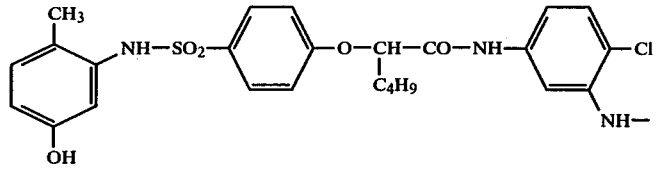 | Cl |

The couplers according to the invention may be synthesized, for example, as follows:

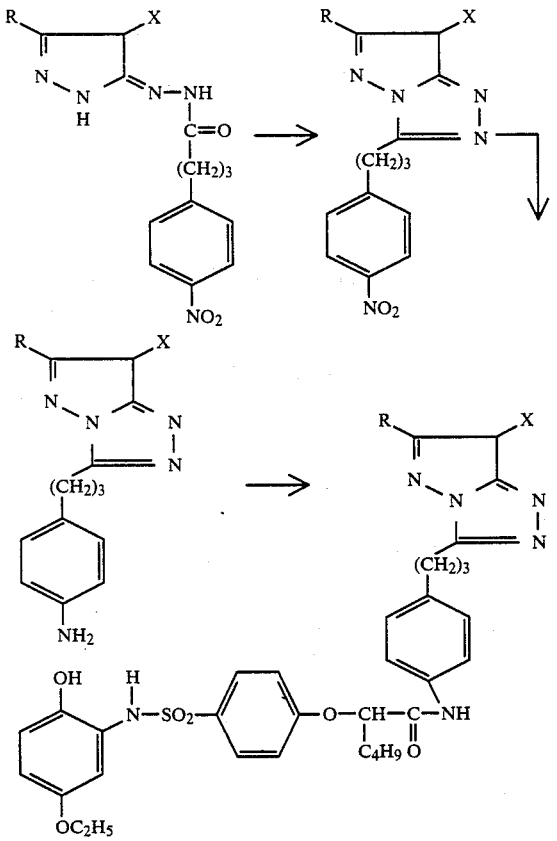

SYNTHESIS EXAMPLE 1

Preparation of coupler M-15

28 g of α-[4-N-(β-hydroxyethylamino)-sulfonyl-phenoxy]-myristic aicd and 15 g of 7-chloro-6 -methyl-3-[3-(p-amino-phenyl)propyl]-1H-pyrazolo[3,2-c]-s-triazole prepared in accordance with EP-A-0 073 636 were dissolved warm in 280 ml of dried dioxane, followed by the addition in portions of 11.5 g of dicyclohexyl carbodiimide. Another dicyclohexyl urea precipitated was filtered off under suction. The filtrate was stirred into 1000 ml of ice/HCl and the deposit precipitated was filterd off under suction and thoroughly dried. Yield after 2×recrystallization from acetonitrile: 28 g, melting point: 118°–121° C.

SYNTHESIS EXAMPLE 2

Preparation of coupler M-20

15 g of 7-chloro-6 methyl-3-[3-(p-aminophenyl)-propyl]-1H-pyrazolo[3,2-c]-s-triazole prepared in accordance with EP-A-0 073 636 and 30 g of α-[4-N-(2-hydroxy-5-ethylsulfonylphenyl)-sulfamoylphenoxy]-myristic acid were dissolved warm in 230 ml of dioxane, followed by the addition in portions of 11.5 g of dicyclohexyl carbodiimide. After stirring for 30 minutes, the urea precipitated was filtered off under suction and the filtrate stirred into 1000 ml water. The deposit precipitated was recrystallized three times from a little diisopropylether. Yield: 32 g, melting point: 90°–95° C.

The couplers according to the inventioon are distinguished not only by the favorable spectral properties of the image dyes produced from them, but also and above all by outstanding emulsate stability. This has a particularly favorable effect upon the sensitometric properties. In particular, magenta images of high maximal color density can be obtained with the color couplers of the pyrazoloazole type according to the invention.

In the production of the photosensitive color photographic recording material, the non-diffusing couplers according to the invention may be incorporated in known manner in the casting solution of the silver halide emulsion layers or other colloid layers. For example, the oil-soluble or hydrophobic couplers may be added, preferably from a solution in a suitable coupler solvent (oil former), to a hydrophilic colloid solution, optionally in the presence of a wetting agent or dispersant. The hydrophilic casting solution may of course contain other standard additives in addition to the binder. The solution of the coupler need not be directly dispersed in the casting solution for the silver halide emulsion layer or other water-permeable layer. Instead, it may even be advantageously first dispersed in an aqueous non-photosensitive solution of a hydrophilic colloid and the mixture obtained—optionally after removal of the low-boiling organic solvents used—subsequently mixed with the casting solution for the photosensitive silver halide emulsion layer or other water-permeable layer before application.

Suitable photosensitive silver halide emulsions are emulsions of silver chloride, silver bromide or mixtures thereof, optionally with a small content of silver iodide of up to 10 mole % in one of the hydrophilic binders normally used. Gelatin is preferably used as the binder for the photographic layers, although it may also be completely or partly replaced by other natural or synthetic binders.

The emulsions may be chemically or spectrally sensitized in the usual way and the emulsion layers and also other non-photosensitive layers may be hardened in the usual way with known hardening agents.

Color photographic recording materials normally contain at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers need not necessarily contain a spectral sensitizer because, in many cases, the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (DE-C-1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-1 958 709, DE-A-2 530 645, DE-A-2 622 922).

Color photographic recording materials for the production of multicolor images by chromogenic development normally contain non-diffusing color couplers for producing the different component dye images cyan, magenta and yellow in spatial and spectral association with the silver halide emulsion layers of different spectral sensitivity.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally non-photosensitive binder layer.

By spectral association is meant that the spectral sensitivity of each of the photosensitive silver halide emulsion layers and the color of the component dye image produced from the particular spatially associated color coupler bear a certain relationship to one another, a component dye image relating to another color (generally for example the colors cyan, magenta or yellow in that order) being associated with each of the spectral sensitivities (red, green, blue).

One or more color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one non-diffusing color coupler for producing the cyan component dye image, generally a coupler of the phenol or $\alpha$-naphthol type, is associated with red-sensitive silver halide emulsion layers. At least one non-diffusing color coupler for producing the magenta component dye image, in the present case a color coupler corresponding to formula I, is associated with green-sensitive silver halide emulsion layers. Finally, at least one non-diffusing color coupler for producing the yellow component dye image, generally a color coupler containing an open-chain ketomethylene group, is associated with blue-sensitive silver halide emulsion layers. Color couplers of this type are known in large numbers and are described in a number of patent specifications. Reference is made here for example to the publications "Farbkuppler (Color Couplers)" by W. PELZ in "Mitteilungen aus den Forschungslaboratorien dere Agfa, Leverkusen/Müchen", Vol. III, page 111 (1961) and by K. VENKATARAMAN in "The Chemistry of Synthetic Dyes", Vol. 4, 341 to 387, Academic Press (1971).

The color couplers according to the invention may be both typical 4-equivalent couplers and also 2-equivalent couplers in which a smaller quantity of silver halide is required for dye production. 2-equivalent couplers are known to be derived from the 4-equivalent couplers in that they contain in the coupling position a substituent which is eliminated during the coupling reaction. 2-equivalent couplers include both those which are substantially colorless and also those which have a strong color of their own which either disappears during the color coupling reaction or is replaced by the color of the image dye produced. Couplers of the latter type may also be additionally present in the photosensitive silver halide emulsion layers where they serve as masking couplers for compensating the unwanted secondary densities of the image dyes. However, 2-equivalent couplers also include the known white couplers, although couplers such as these do not produce a dye on reaction with color developer oxidation products. 2-equivalent couplers also include the known DIR couplers, i.e. couplers which, in the coupling position, contain a releasable group which is released as a diffusing development inhibitor on reaction with the developer oxidation products. Other photographically active compounds, for example development accelerators or fogging agents, may also be released from such couplers during development.

According to the invention, the color photographic recording material contains at least one coupler having the structure shown in formula I. The advantages which this affords will become apparent, for example, from the following Examples. Although the exact connections are not known in detail, it is assumed that the advantages obtained with the couplers according to the invention are attributable to the structure of the couplers shown in formula I and more especially to the special structure of the ballast group containing a sulfamoylphenoxy group.

The characteristic group of the couplers corresponding to formula I does not have any significant effect upon the spectral properties of the image dyes produced. Instead, it acts as a so-called emulsifying group promoting the dispersibility of the couplers and the stability of the color photographic recording materials.

In addition to the constituents mentioned above, the color photographic recording material according to the invention may contain other additives, such as for example antioxidants, dye stabilizers and agents for influencing the mechanical and electrostatic properties. In order to reduce or avoid the adverse effect of UV light on the dye images produced with the color photographic recording material according to the invention, it is of advantage for example to use UV absorbers in one or more of the layers present in the recording material, preferably in one of the upper layers. Suitable UV absorbers are described, for example, in US-A-3 253 921, in DE-C-2 036 719 and in EP-A-0 057 160.

To produce color photographic images, the color photographic recording material according to the invention, which contains at least one silver halide emulsion layer and at least one coupler of formula I associated therewith, is developed with a color developer compound. Suitable color developer compounds are any developer compounds which are capable of reacting with color couplers in the form of their oxidation product to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

EXAMPLE 1

Quantities of 8 mmoles magenta-coupler were dissolved in ethyl acetate (EA) heated to approx. 50° C. in a ratio of 1:3, followed by the addition to the resulting solution of dibutylphthalate (DBP) and Manoxol in such quantities that the ratio of coupler to DBP to EA to Manoxol is 1:1:3:0.1. The mixture was then emulsified in a 7.5% gelatin solution. A ratio of coupler to gelatin of approx. 1:2 is obtained, depending on the molecular weight. The emulsate was stirred for 6 minutes at 1000 r.p.m., undergoing a spontaneous increase in temperature to around 50° C. The EA was removed in a water jet vacuum (200–300 mbar).

The quality of the fresh coupler emulsates was evaluated as follows using a phase contrast or polarization microscope:

(a) Particle size
1=very fine (<0.5 mm)
2=fine (<1 μm)
3=fine with some relatively coarse particles
4=medium
5=coarse (b) Homogeneity
1=no crystals discernible
2=some crystals discernible
3=numerous crystals discernible
4=fully crystallized The same evaluation was made after the emulsates had been intensively stirred for 3 and 6 hours at 50° C. Emulsates of the comparison couplers (Coup 1–11) were prepared and evaluated for comparison.

Coup 1:

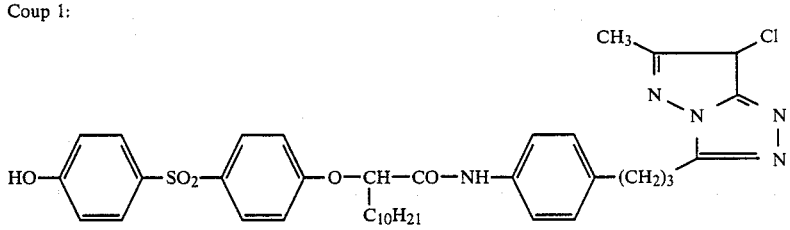

Coup 2:

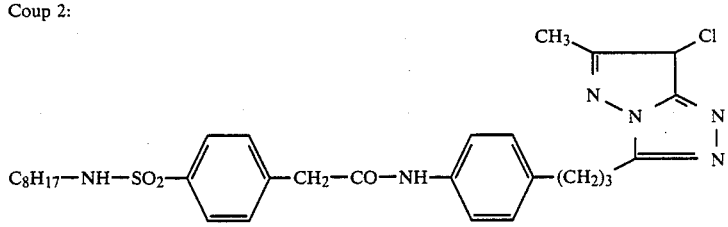

Coup 3:

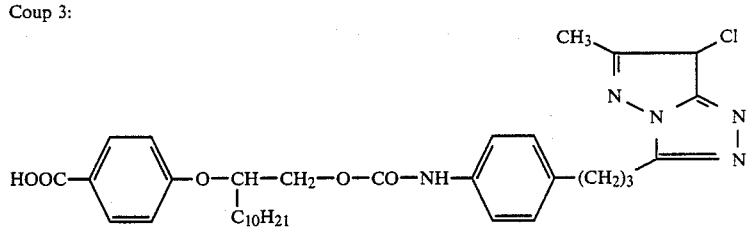

Coup 4:

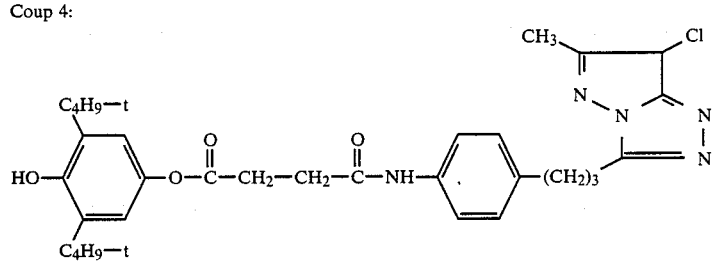

Coup 5:

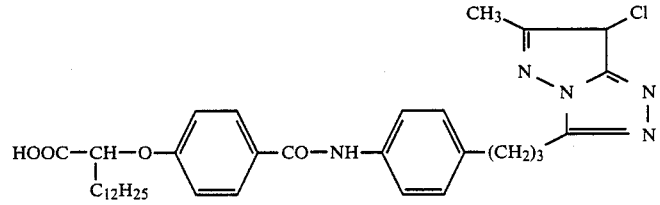

-continued
Coup 6:
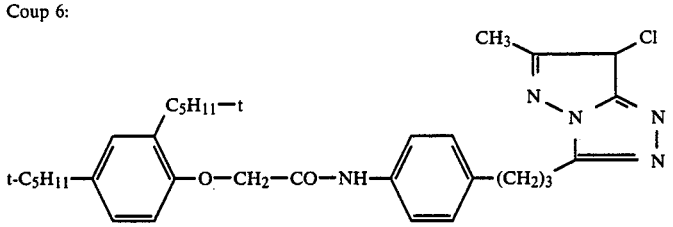
Coup 7:
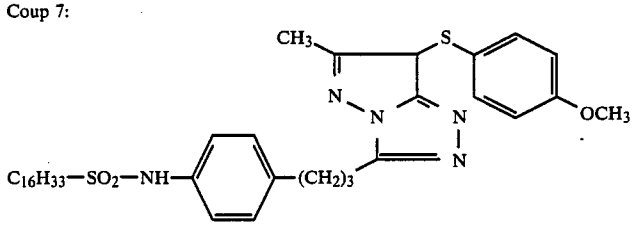
Coup 8:
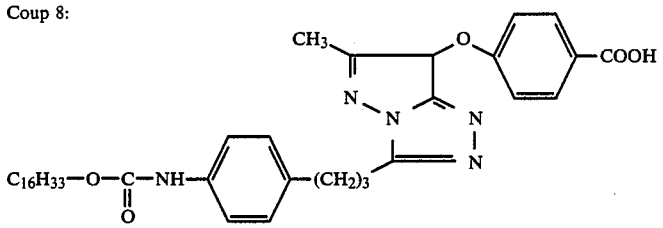
Coup 9:
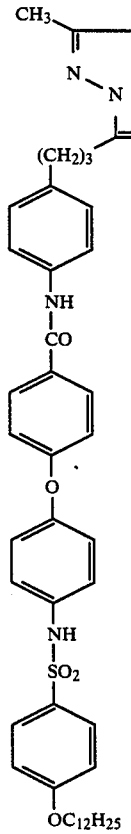

-continued

Coup 10:

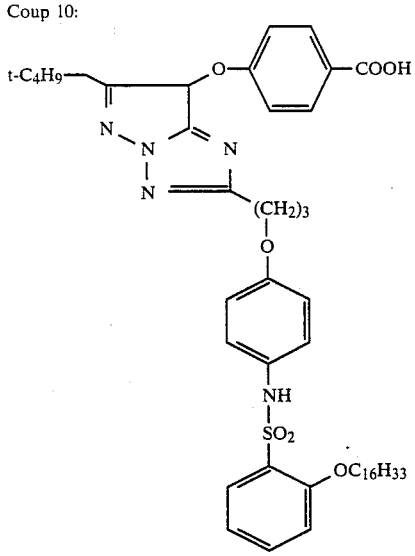

Coup 11:

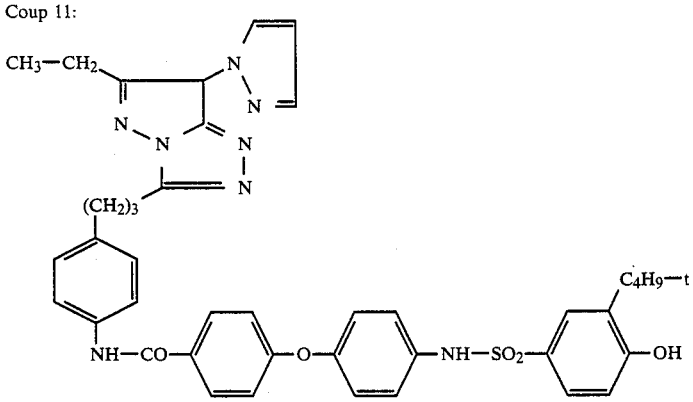

The results are shown in Table 1.

TABLE 1

| | Quality of the coupler emulsates | | | | | |
|---|---|---|---|---|---|---|
| | Fresh | | 3 h/50° C. | | 6 h/50° C. | |
| Coupler | a | b | a | b | a | b |
| Coup 1 | 1 | 1 | 2 | 2 | 2 | 3 |
| Coup 2 | 3 | 2 | 3 | 2 | 3 | 3 |
| Coup 3 | 3 | 3 | 5 | 4 | — | — |
| Coup 4 | 4 | 4 | 5 | 4 | — | — |
| Coup 5 | 5 | 3 | 5 | 3 | 5 | 3 |
| Coup 6 | 2 | 2 | 2 | 2 | 4 | 3 |
| Coup 7 | 3 | 3 | 3 | 3 | 3 | 3 |
| Coup 8 | 3 | 3 | 3 | 3 | 4 | 3 |
| Coup 9 | 4 | 4 | 5 | 4 | — | — |
| Coup 10 | 3 | 3 | 3 | 3 | 4 | 4 |
| Coup 11 | 3 | 4 | 3 | 4 | 4 | 4 |
| M-15 | 1 | 1 | 1 | 1 | 2 | 1 |
| M-16 | 1 | 1 | 1 | 2 | 2 | 2 |
| M-17 | 2 | 1 | 2 | 1 | 2 | 1 |
| M-23 | 1 | 1 | 1 | 1 | 1 | 1 |
| M-24 | 1 | 1 | 1 | 1 | 2 | 2 |
| M-26 | 2 | 1 | 2 | 1 | 2 | 1 |
| M-12 | 1 | 1 | 1 | 1 | 2 | 1 |
| M-32 | 2 | 2 | 2 | 2 | 2 | 2 |
| M-41 | 2 | 1 | 2 | 1 | 2 | 1 |
| M-47 | 2 | 1 | 2 | 1 | 2 | 1 |

EXAMPLE 2

The emulsates prepared in accordance with Example 1 were mixed with a silver bromide iodide emulsion (0.7 mole % iodide) in a ratio of 1 mole of coupler to 5.2 moles $AgNO_3$ and the resulting mixture was applied to a layer support of cellulose acetate and overcoated with a protective layer of a 3% gelatin solution containing a carbamoyl pyridinium betaine (CAS Reg. no. 65411-60-1) as hardener. After drying and cutting up, the samples thus prepared were exposed behind a step wedge and processed by the negative AP 70 process (38° C.).

| Bath | Mins. |
|---|---|
| Color developer (CD 70) | 3.25 |
| Bleaching | 6.5 |
| Rinsing | 3.0 |
| Fixing | 6.5 |
| Rinsing | 6.0 |

The following baths were used:

Color developer 8000 ml water
17 g hydroxyethanediphosphonic acid Na

-continued

| | | |
|---|---|---|
| 12 | g | ethylenediamine tetra-acetic acid (EDTA acid) |
| 47 | g | 1-(N—ethyl-N—hydroxyethyl)-3-methyl-p-phenylenediamine |
| 25 | g | hydroxylammonium sulfate |
| 39 | g | sodium sulfite |
| 15.5 | g | sodium hydrogen carbonate |
| 335 | g | potassium carbonate |
| 13.5 | g | potassium bromide |
| | | make up with water to 10 l; pH 10.0 |

Bleaching bath

| | | |
|---|---|---|
| 8000 | ml | water |
| 1390 | g | ammonium bromide |
| 865 | g | EDTA $NH_4$—Fe |
| 163 | g | EDTA acid |
| 100 | g | ammonia |
| | | make up with water to 10 l and adjust to pH 6.0 + −0.1 with approx. 15 ml glacial acetic acid. |

Fixing bath

| | | |
|---|---|---|
| 8000 | ml | water |
| 1500 | g | ammonium thiosulfite |
| 100 | g | sodium sulfite |
| 20 | g | sodium hexamethaphosphate |
| | | make up with water to 10 l; pH 7.5 |

Coup 12

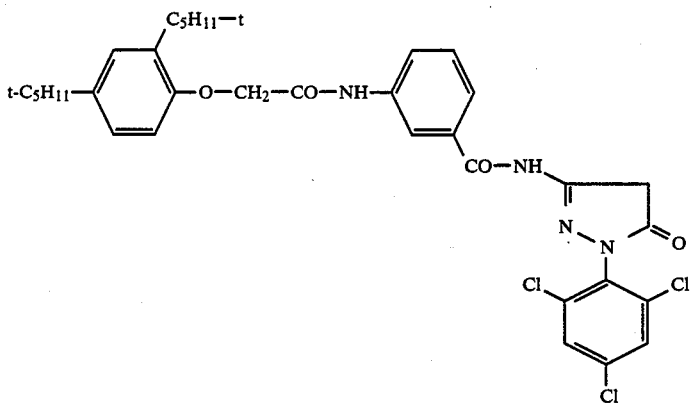

Coup 13

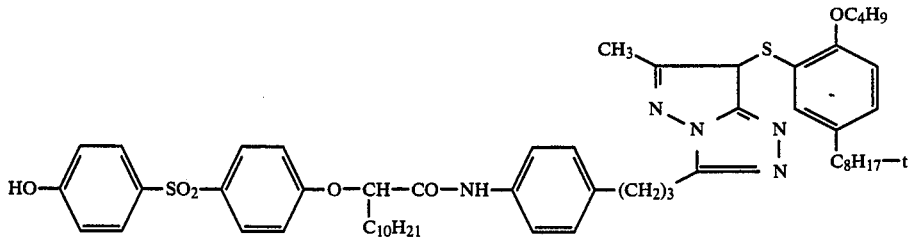

Coup 14

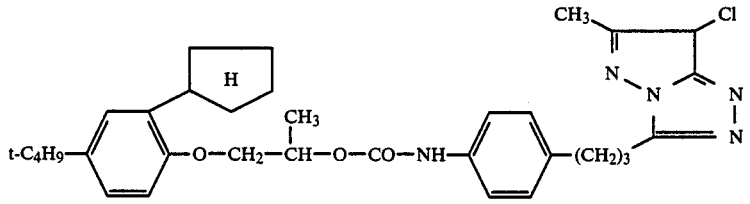

Coup 15

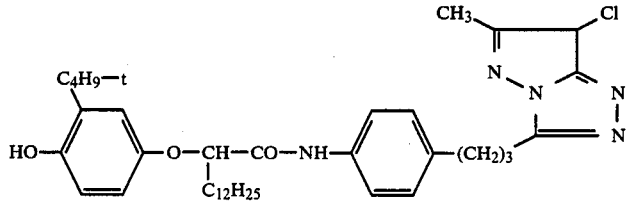

-continued

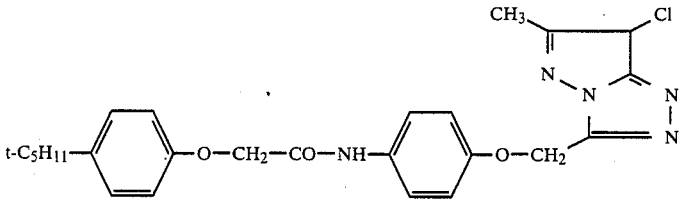

Coup 16

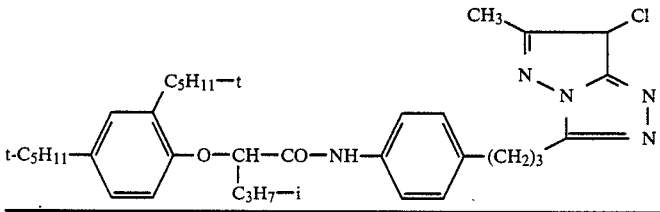

Coup 17

Table 2 shows that the couplers according to the invention are distinguished from the state-of-the-art couplers (Coup 12 to Coup 17) by high sensitivity, excellent colour yield CY $$\left(CY = \frac{D_{max}}{\text{Ag applied}}\right)$$

for comparable fresh fogging values.

TABLE 2

| | E [DIN] | γ | CY | S | $\lambda_{max}$ [nm] |
|---|---|---|---|---|---|
| Coup 12 | ±0 (standard) | 0.5 | 1.40 | 0.13 | 553 |
| Coup 13 | −5 | 0.5 | 2.07 | 0.10 | 552 |
| Coup 14 | +0.5 | 0.57 | 1.82 | 0.14 | 548 |
| Coup 15 | −8.6 | 0.30 | 1.38 | 0.10 | 550 |
| Coup 16 | −10 | 0.20 | 0.30 | 0.90 | — |
| Coup 17 | +0.5 | 0.40 | 1.85 | 0.70 | 548 |
| M-15 | +4.0 | 1.04 | 3.04 | 0.10 | 551 |
| M-16 | +1.5 | 0.95 | 3.05 | 0.11 | 552 |
| M-17 | +2.0 | 0.95 | 2.95 | 0.11 | 550 |
| M-18 | +1.3 | 0.70 | 2.81 | 0.12 | 550 |
| M-19 | +1.0 | 0.80 | 2.75 | 0.11 | 552 |
| M-23 | +4.0 | 1.20 | 3.20 | 0.10 | 550 |
| M-20 | +5.0 | 1.10 | 3.30 | 0.11 | 550 |

EXAMPLE 3

Individual layers prepared in accordance with Example 2 of the couplers shown in Table 3 were exposed 0, 3, 7, 14 and 21 days before exposure and processing to a formalin concentration of 10 ppm at 70% relative air humidity.

After processing by the negative AP 70 process in accordance with Example 2, the following color density values were obtained.

TABLE 3

| | $D_{max}$ after exposure to $CH_2O$ | | | | |
|---|---|---|---|---|---|
| Days: | 0 | 3 | 7 | 14 | 21 |
| Coup 12 | 2.2 | 2.0 | 1.6 | 1.10 | 0.8 |
| Coup 15 | 2.4 | 2.0 | 1.8 | 1.5 | 1.3 |
| M-23 | 2.8 | 2.8 | 2.8 | 2.75 | 2.80 |
| M-17 | 3.0 | 3.0 | 2.95 | 2.80 | 2.80 |
| M-8 | 2.9 | 2.95 | 2.90 | 2.70 | 2.70 |
| M-41 | 2.85 | 2.80 | 2.75 | 2.50 | 2.50 |

EXAMPLE 4

A color photographic recording material for negative color development was prepared by applying the following layers in the order indicated to a transparent layer support of cellulose triacetate. The quantities applied are all based on 1 square meter. For the silver halide applied, the corresponding quantities of $AgNO_3$ are indicated. All the silver halide emulsions were stabilized with 0.5 g of 4-hydroxy-6-methyl-1,3,3a,7-tetraazaindene per 100 g $AgNO_3$.

Layer 1 (Antihalo layer)
- Black colloidal silver sol containing
  - 0.18 g Ag
  - 0.30 g UV absorber UV-1
  - 1.5 g gelatin Layer 2 (Intermediate layer)
- Silver bromide iodide emulsion (0.8 mole % iodide) of 0.15 g $AgNO_3$ containing
  - 0.15 g 2,5-dioctyl hydroquinone
  - 0.11 g coupler C-1
  - 0.3 g gelatin Layer 3 (First red-sensitized layer)
- Red-sensitized silver bromide iodide emulsion (5 mole % iodide) of 0.7 g $AgNO_3$ containing
  - 0.1 g coupler C-2
  - 0.3 g coupler C-3
  - 0.01 g coupler C-4
  - 1.2 g gelatin Layer 4 (Second red-sensitized layer)
- Red-sensitized silver bromide iodide emulsion (10 mole % iodide) of 1.2 g $AgNO_3$ containing
  - 0.1 g coupler C-2
  - 0.05 g coupler C-3
  - 0.05 g coupler C-5
  - 0.9 g gelatin Layer 5 (Third red-sensitized layer)
- Red-sensitized silver bromide iodide emulsion (10 mole % iodide) of 2.0 g $AgNO_3$ containing
  - 0.05 g coupler C-3
  - 0.15 g coupler C-5
  - 0.003 g coupler C-6
  - 0.8 g gelatin Layer 6 (Intermediate layer)
- 0.5 g gelatin Layer 7 (First green-sensitized layer)
- Green-sensitized silver bromide iodide emulsion (5 mole % iodide) of 0.5 g $AgNO_3$ containing 0.3 g coupler C-7
0.4 g coupler C-8
0.5 g coupler C-9
0.5 g coupler C-10
1.2 g gelatin Layer 8 (Second green-sensitized layer)
Green-sensitized silver bromide iodide emulsion Layer 8 (Second green-sensitized layer)
Green-sensitized silver bromide iodide emulsion (6 mole % iodide) of 1.0 g $AgNO_3$ containing
0.25 g coupler C-7
0.01 g coupler C-8
0.01 g coupler C-9
0.01 g coupler C-10
1.7 g gelatin Layer 9 (Third green-sensitive layer)
Green-sensitized silver bromide iodide emulsion (10 mole % iodide) of 1.5 g $AgNO_3$ containing
0.015 g coupler C-8
0.07 g coupler C-11
0.002 g coupler C-12
1.0 g gelatin Layer 10 (Yellow filter layer)
Yellow colloidal silver sol of 0.05 g Ag containing
0.03 g 3,5-di-tert.-octyl hydroquinone and
0.6 g gelatin Layer 11 (First blue-sensitized layer)
Silver bromide iodide emulsion (5 mole % iodide) of
0.3 g $AgNO_3$ containing
0.7 g coupler C-13
0.03 g coupler C-14
1.4 g gelatin Layer 12 (Second blue-sensitive layer)
Silver bromide iodide emulsion (5 mole % iodide) of
0.3 g $AgNO_3$ containing
0.25 g coupler C-13
0.6 g gelatin Layer 13 (Micrate layer)
Silver bromide iodide emulsion (2 mole % iodide) of
0.4 g $AgNO_3$ containing
0.1 g gelatin Layer 14 (Third blue-sensitive layer)
Silver bromide iodide emulsion (10 mole % iodide) of
0.8 g $AgNO_3$ containing
0.2 g coupler C-13
0.5 g gelatin Layer 15 (First protective layer)
0.14 g UV absorber UV-1
0.20 g UV absorber UV-2
0.4 g gelatin Layer 16 (Second protective layer)
0.95 g hardener CAS Reg. no. 65411-60-1
0.23 g gelatin The recording material thus prepared is called material A (for comparison). A material B according to the invention was similarly prepared, differing from material A solely in the fact that the couplers C-7 and C-11 in layers 7, 8 and 9 were replaced by the coupler M-20.

The following sensitometric data were obtained after exposure and processing in the same way as described in Example 2. The values obtained when materials A and B were stored for 1 week in a drying cabinet (35° C.; 85% rel. humidity) before exposure are shown in brackets.

TABLE 4

| Material | Coupler | E [DIN] | $D_{max}$ | $\gamma$ | $\lambda_{max}$ [nm] | S |
|---|---|---|---|---|---|---|
| A | C-7 C-11 | ±0 | 2.2 | 0.8 | 554 | 0.12 |
| | | (±0.5) | (2.0) | (0.5) | 554 | (0.18) |
| B | M-20 | ±2.0 | 2.95 | 1.3 | 552 | 0.11 |
| | | (−2.0) | (2.95) | (1.3) | (552) | (0.10) |

The following compounds were used:

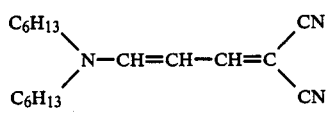

UV-1

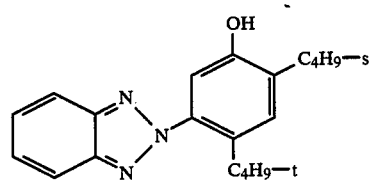

UV-2

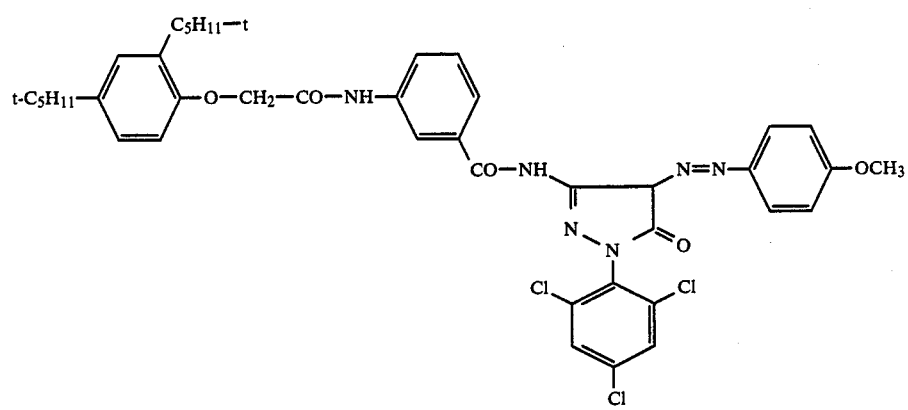

C-1

-continued
C-2
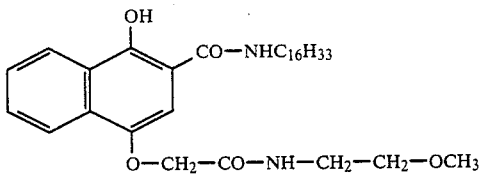
C-3
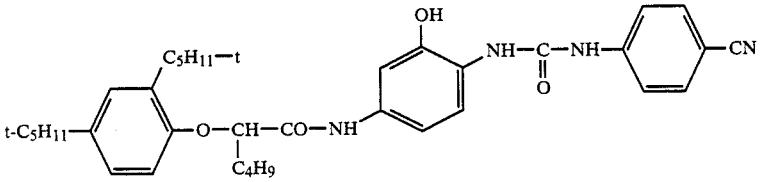
C-4
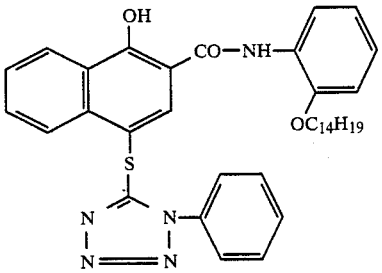
C-5
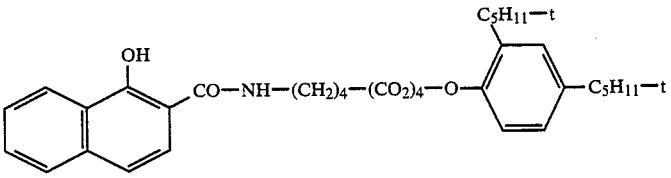
C-6
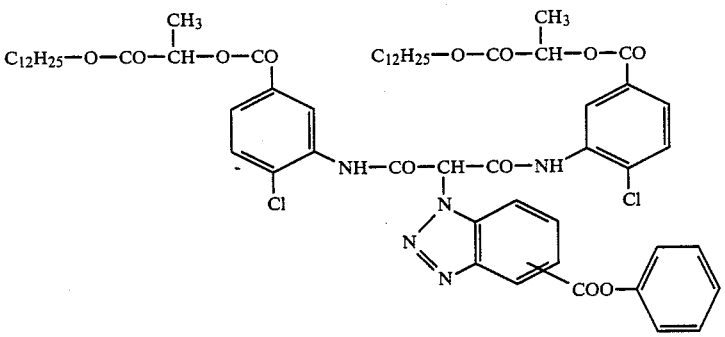
C-7
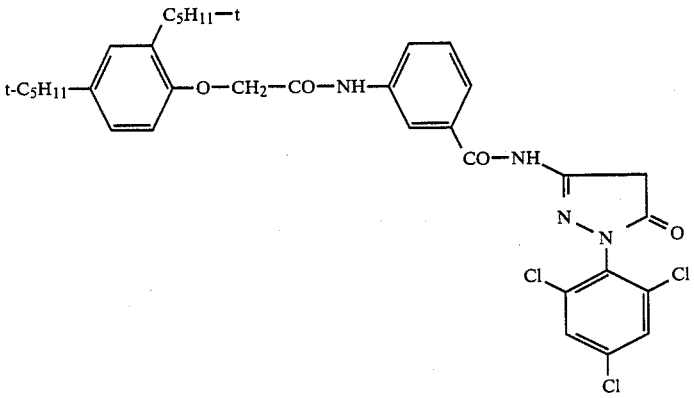

-continued
C-8
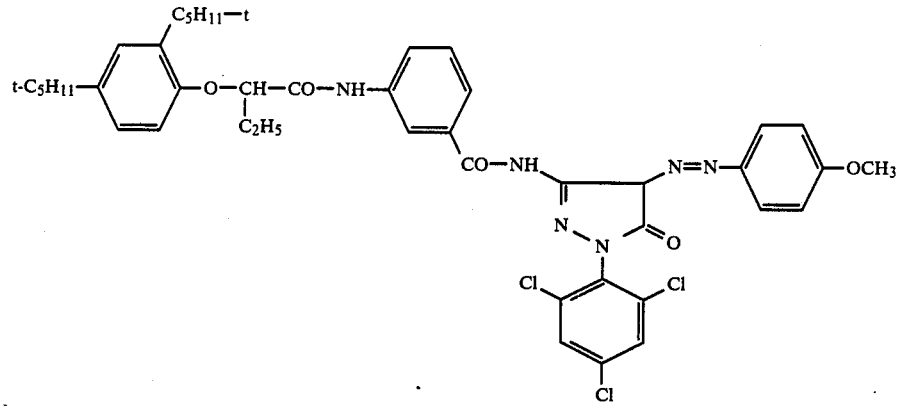
C-9
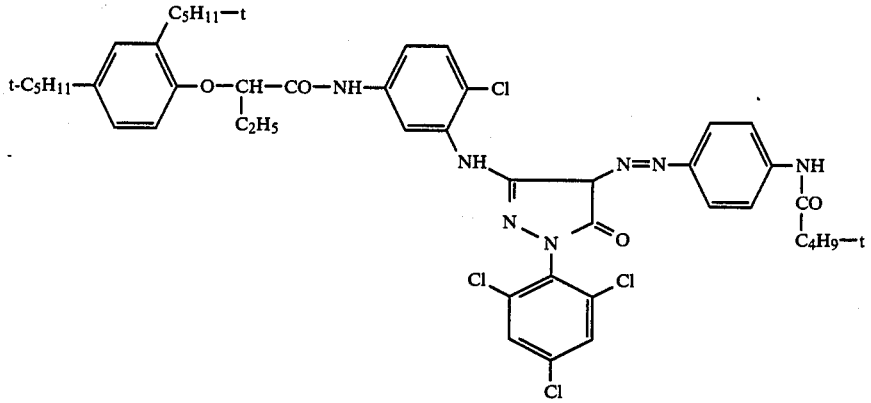
C-10
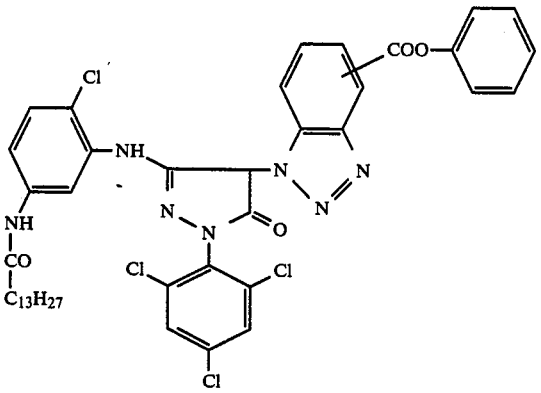
C-11
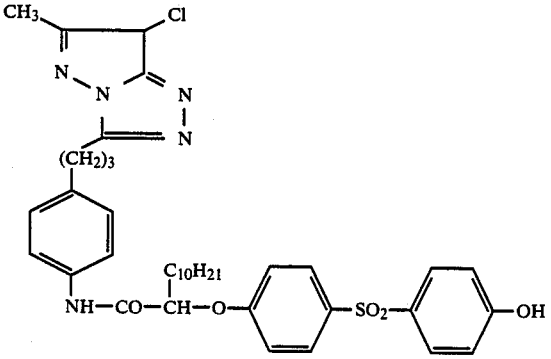

-continued

C-12

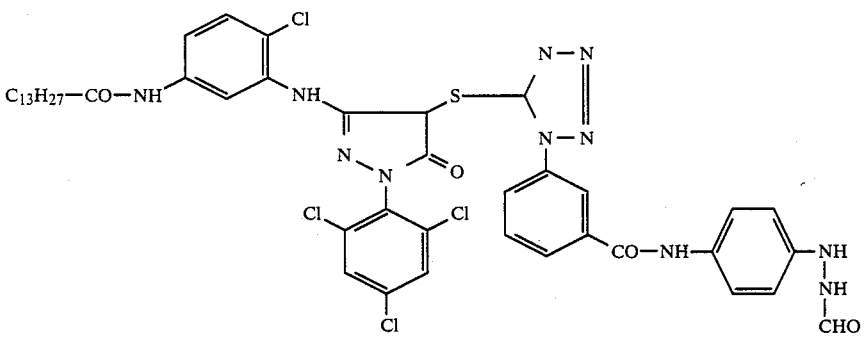

C-13

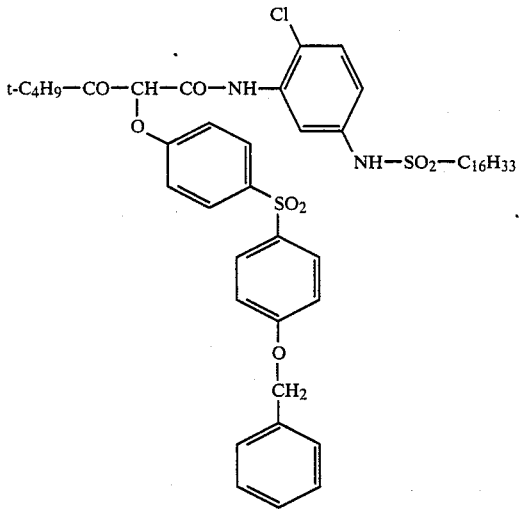

C-14

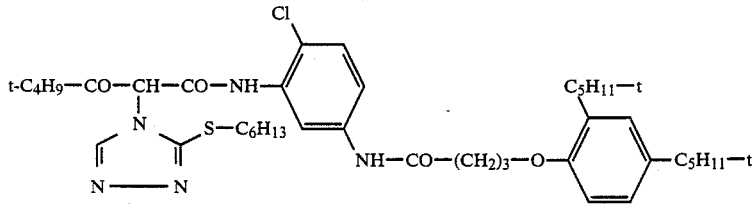

I claim:

1. A color photographic recording material containing at least one silver halide emulsion layer and at least one color coupler of the pyrazoloazole type which contains a diffusion-inhibiting radical having the following formula:

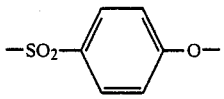

wherein the color coupler corresponds to one of the following formulae I-1, I-2, I-4 and I-5:

I-1

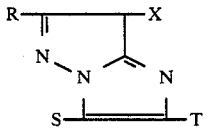

-continued

I-2

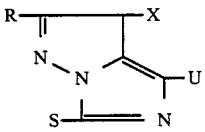

I-4

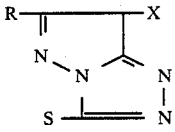

I-5

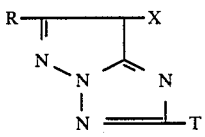

in which

X represents hydrogen, a halogen atom or a cyclic group attached to the coupling position by a sulfur atom or a nitrogen atom; R, S, T and U represent hydrogen, alkyl, aralkyl, aryl, alkoxy, aroxy, alkylthio, arylthio, amino, anilino, acylamino, cyano, alkoxycarbonyl, carbamoyl or sulfamoyl; but in each of the formulae at least one of the substituents R, S, T and U represents a group having the formula

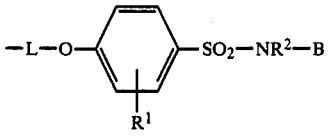

in which

L represents a bond containing at least 4 carbon atoms;

B represents alkyl, aryl or a heterocyclic group;

$R^1$ represents H, halogen, alkyl, alkoxy;

$R^2$ represents H, alkyl, cycloalkyl; and

L and B together contain at least 12 carbon atoms.

2. A recording material according to claim 1, in which the bond L has the following structure $$-(L^1)_l-(L^2)_m-(L^3)_n-L^4-$$

in which $L^4$ represents that part of the bond situated next to the sulfamoylphenoxy group and in which l, m, n=0 or 1, $L^1$ is —O—, —NH—, —NH—CO—;

$L^2$ is alkylene, aralkylene or arylene;

$L^3$ is —NH—CO—, —CO—, —NH—, —O—;

$L^4$ is alkylene containing from 1 to 19 carbon atoms, aralkylene or arylene or (where l, m, n=0) is a bond having the following structure

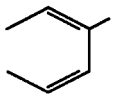

with the proviso that n=1 where m=1.

3. A recording material as claimed in claim 1, characterized in that, in formula I, an alkyl or aryl radical represented by B is substituted by a non-ionic hydrophilic group.

* * * * *